United States Patent [19]

Saji et al.

[11] Patent Number: 5,032,225

[45] Date of Patent: Jul. 16, 1991

[54] TEMPERATURE CONTROLLED METHOD OF COATING A PAPER WEB

[75] Inventors: Soichi Saji; Yoshiaki Tanaka, both of Amagasaki; Kenichiro Yokota; Masahiro Yamamoto, both of Anan, all of Japan

[73] Assignee: Kanzaki Paper Mfg. Co., Ltd., Tokyo, Japan

[21] Appl. No.: 618,394

[22] Filed: Nov. 27, 1990

[30] Foreign Application Priority Data

Nov. 28, 1989 [JP] Japan ..... 1-311436

[51] Int. Cl.[5] ..... D21F 19/00; B05D 3/00

[52] U.S. Cl. ..... 162/135; 162/198; 162/184; 427/8; 427/326; 427/395

[58] Field of Search ..... 162/135, 198, 184; 427/8, 326, 395

[56] References Cited

U.S. PATENT DOCUMENTS 2,072,670 3/1937 Fleck ..... 162/184

3,136,652 6/1984 Bicknell ..... 162/184

*Primary Examiner*—Karen M. Hastings

*Assistant Examiner*—Brenda Lamb

*Attorney, Agent, or Firm*—Flynn, Thiel, Boutell & Tanis

[57] ABSTRACT

When a paper web is coated on paper machine the surface temperature is controlled at or below a temperature determined by an equation (1) given below, in order to obtain a coated paper having an evenly coated layer.

$$T = -10m + \left(\frac{1}{10}v\right)^{\frac{1}{2}} + X \quad (1)$$

where

T: surface temperature of the paper web (°C.)

m: wet value of the paper web (g by weight)

v: viscosity of the coating composition (cps)

x: x=40 or 35 with 35 being the preferred form of the equation.

4 Claims, No Drawings

TEMPERATURE CONTROLLED METHOD OF COATING A PAPER WEB

FIELD OF THE INVENTION

The present invention relates to a method of making a coated paper by on-machine coating. More particularly, the invention relates to a method of making a coated paper by on-machine coating, which coated paper has satisfactory smoothness even when the amount of coating is relatively small, therefore said coated paper being usuful as a base paper for thermosensitive materials.

BACKGROUND OF THE INVENTION

In making a coated paper, a method of coating a paper web, which is continuously moving on a paper machine, on the downstream side of the drying part of the paper machine has been widely used because it makes the production process simpler and more efficient as compared with off-machine coating.

In contrast with the off-machine coating in which a coating composition is applied to a paper web at an ambient temperature, in on-machine coating the coating composition permeates into the paper web rapidly because the surface temperature of the paper web to be coated with the coating composition is ralatively high. Therefore, unless the amount of coating is considerably increased, the coating cannot correct the unevenness of the paper web itself, and the coated surface on the paper web is uneven as well.

A coated paper having an uneven coated surface is not suitable for use as a printing paper because the ink receptivity and water absorption thereof are uneven. If such a coated paper is used as an undercoated base paper for a thermosensitive paper, the thermosensitive material will cause uneven color development. The thermosensitive paper comprises an undercoated base paper coated on its surface with a thermosensitive coating layer, the weight of said coating usually being as small as about 5 g/m$^2$. Therefore, the surface evenness of the undercoated base paper is very important to obtain a good recording image.

There are various means for preventing the coating composition from rapidly permeating into a paper web. One of them is to make the size stronger or raise the density of the paper web. However, the degree of permeation of the coating composition into the paper web depends not only upon the size properties and density of the paper web but also upon the viscosity of the coating composition and the surface temperature of the paper web at the time of coating. However, in the conventional on-machine coating, the interrelations between these factors have not been made clear.

SUMMARY OF THE INVENTION

The inventors have found that in making a coated paper by on-machine coating it is possible to obtain a very high quality coated paper having an even coated surface even when the amount of coating is relatively small, by adjusting the surface temperature of a paper web immediately before coating to or below a temperature determined by a specific equation (1) or (2) in which the viscosity of the coating composition and the wet value of the paper web which is about to be coated with said coating composition are variables.

Therefore, it is an object of the present invention to provide a method of making a coated paper by coating on paper machine a paper web having a wet value of −0.30 to +0.20 g by weight, which paper web is continuously moving on a paper machine and has passed the drying part thereof, with a coating composition having a viscosity of 20 to 3,000 cps, the improvement comprising maintaining the surface temperature of the paper web immediately before coating at or below a temperature determined by the following equation (1).

$$T = -10m + \left(\frac{1}{10}v\right)^{\frac{1}{4}} + X \qquad (1)$$

where

T: surface temperature of the paper web (°C.)

m: wet value of the paper web (g by weight)

v: viscosity of the coating composition (cps)

x: x being 40 or 35 with 35 being the preferred form of the equation.

As apparent from the equations above, the surface temperature of the paper web immediately before coating should be reduced as the wet value of the paper web is larger or the viscosity of the coating composition is smaller.

In the present specification and claims, "viscosity" means a viscosity measured by means of a Brookfield Viscometer on the conditions of 30° C. and 60 rpm. "Wet value" means the sum (g by weight) or grams force of the following two forces:

(1) a force exerted on a test piece of a paper web, 2 cm×5 cm, londitudinally put into stationary pure water down to a depth of 12 mm at a speed of 16 mm per second, said force being measured in two seconds after the immersion is started (2) a buoyancy by the immersed volume (2 cm×12 cm×thickness of the test piece) of the test piece Generally speaking, at the very moment the test piece contacts with water, the contact angle between the two is $0° < \theta < 90°$. Therefore, the test piece receives an upward force and the wet value thereof is minus. As the test piece is wetter, the contact angle $\theta$ is enlarged. When $\theta = 90°$, the upward force becomes 0. As the test piece is further wetted, then $\theta$ is larger than 90°, the test piece receiving a downward force, the wet value becoming plus. The buoyancy of the immersed test piece is always directed upward and therefore the value thereof is minus.

In the present invention, the wet value of the paper web was measured by means of "Dynamic Wettability Tester WETT-3000" made by RHESCA Co., Ltd., Japan.

DETAILED DESCRIPTION

In on-machine coating, a paper web immediately before being coated with a coating composition usually maintains a surface temperature of above 50° C., or even above 70° C. If the coating composition is applied under these conditions, the coating composition has a tendency to rapidly permeate into the paper web because the surface tension and viscosity thereof are reduced. Therefore, the coating cannot remove the unevenness of the base paper such as rough formation and uneven sizing, and the coated layer is liable to be uneven.

The present invention makes it possible to obtain an excellent coated paper having an even coated layer by adjusting the surface temperature of the paper web immediately before coating according to the viscosity of the coating composition and the wet value of the paper web immediately before coating.

The viscosity of the coating composition used in the present invention is in a range of 20 to 3,000 cps, preferably in a range of 50 to 2,000 cps, more preferably in a range of 50 to 1,000 cps.

If the viscosity of the coating composition is below 20 cps, there will be disadvantages as follows: The coating composition will rapidly permeate into the paper web and may cause uneven coating layer, streaks, splash of the coating, etc. Furthermore, the load for drying the wet coated layer will be increased. If the viscosity of the coating composition is above 3,000 cps, there will be disadvantages both in quality and operation as follows: It will be difficult to adjust the amount of coating with a coating device. Also, streaks and scratches may be caused.

In the present invention, the wet value of the paper web immediately before being coated with a coating composition is in a range of −0.30 to +0.20 g by weight, perferably in a range of −0.25 to +0.10 g by weight. The paper web is difficult to wet as the wet value is smaller. The paper web is easy to wet as the wet value is larger. If the wet value is below −0.30 g by weight, the quality of the coated paper obtained may be lowered. For example, the adhesion between the coated layer and the base paper may be weakened and the surface strength of the coated paper may be decreased. If the wet value exceeds +0.20 g by weight, the coating composition will permeate into the paper web very rapidly and cause uneven coating even when the surface temperature of the paper web immediately before coating is maintained at or below the temperature determined by said equation (1) or preferably by said equation (2). The wet value of the paper web can be adjusted by changing the beating conditions and composition of pulps, pH conditions in paper making, the kind and amount of filler, dry or wet strength agent, internal sizing agent external sizing agent and surface treatment agent, as well as drying conditions. Usable paper machines include a Fourdrinier paper machine, cylinder paper machine, twin-wire paper machine, Yankee paper machine, etc. The weight of the paper web may be in a range of 30 to 400 g/m$^2$ according to the purpose. It does not matter whether the paper web is at an acid pH or a neutral pH.

No interrelations were found between Stöckigt sizing degree and Cobb water absorbency which are the criteria of wettability, and the wet value in the present invention.

The surface temperature of the paper web immediately before coating can be lowered to or below the temperature determined by said equation (1) or preferably by said equation (2) by any means. For example, cold water is supplied to a cylinder dryer on the downstream side of the drying part of the paper machine, or cold air is blown against the paper web immediately before coating.

Pigments contained in the coating composition may be conventional pigments for paper coating such as clay, kaolin, aluminum hydroxide, calcium carbonate, titanium dioxide, barium sulfate, zinc sulfate, satin white, calcium sulfate, talc and plastic pigments. Furthermore, one kind or more than one kind of pigments having strong oil absorbency may be chosen, according to the desired paper quality, from calcined clay, aluminum oxide, magnesium carbonate, diatom earth, amorphous silica, aluminum silicate, magnesium silicate, calcium silicate, magnesium alminosilicate, etc.

Adhesives may be chosen from starch, casein, polyvinyl alcohol, methyl cellulose, carboxymethyl cellulose, hydroxymethyl cellulose, polyacrylic acid and other water soluble high polymers, styrene-butadiene copolymer, styrene-acrylic copolymer, emulsion containing complex particles of colloidal silica and styrene acrylic copolymer, acrylic copolymer and other synthetic resin emulsions.

In the present invention, the ratio between the pigments and adhesives in the coating composition is not limited. Usually, 5 to 50 parts by weight of adhesives are used per 100 parts by weight of pigments.

The coating composition contains, as required, some auxiliary agents such as anti-foaming agents, coloring agents, releasing agents and flow modifiers. As auxiliary agents for promoting the solidification of the coated layer, 0.1 to 10 parts by weight of amine, amide, polyacrylic amine, etc. may be added per 100 parts by weight of pigments. The solid matter concentration of the coating composition is not limited, but it is generally in a range of 10 to 70% by weight.

The coating composition comprising said pigments and adhesives are applied to a base paper on paper machine by means of any of conventional coating devices such as a blade coater, air knife coater, roll coater, reverse roll coater, bar coater, curtain coater, die slot coater, gravure coater, Champflex coater and size press.

The amount of coating is not limited, but preferably it is in a range of 2 to 50 g/m$^2$ per surface. The coating composition may be applied, on paper machine, in layers or to both surfaces of the base paper by means of a plurality of coater heads.

The wet coated layer may be dried by any of the following means: steam heating, hot air heating, gas heating, electric heating, infrared ray heating, high frequency heating, laser heating, electron ray heating, etc.

The paper coated with a coating composition and dried can be calendered either on paper machine or off paper machine as required by means of calenders having metal rolls and elastic rolls such as a machine calender, super calender, gloss calender and soft compact calender.

According to the method of the present invention, it is possible to obtain undercoated base papers for information papers such as no carbon copying papers, thermosensitive papers and ink jet papers as well as coated papers for printing of various grades. The method of the present invention is suitable particularly for making undercoated base papers for thermosensitive materials.

EXAMPLES

The present invention will now be described in detail with reference to examples. It is to be understood that the present invention is not limited to the examples. In the examples, "parts" or "%" (percent) means "parts" or "%" by weight, unless otherwise stated.

EXAMPLE 1

Preparing an undercoated base paper for a thermosensitive paper

A coating composition having a solid matter concentration of 40% and a viscosity of 300 cps was prepared by mixing and agitating 100 parts calcined clay ("Ansilex" made by EMC, USA), 10 parts (solid matter)

styrene-butadiene copolymer latex ("Dow-1571" made by Asahi-Dow Co., Ltd., Japan), 5 parts (solid matter) oxidized starch, and water.

A paper web (45 g/m$^2$) having a wet value of −0.10 g by weight was dried by means of a cylinder dryer, a cylinder thereof immediately before the coater was adapted to be used as a cooling dryer by limiting steam supply thereto by means of a steam valve thereof, and cold air was blown against the paper web immediately before the coater so that the surface temperature of the paper web was 40° C. The paper web was coated on one surface with said coating composition by means of a Champflex coater so that the coating weight after drying was 7 g/m$^2$, and the paper was dried. Thus, an undercoated base paper for a thermosensitive paper was obtained.

Forming a thermosensitive layer (1) Preparing composition "A"

10 parts: 3-(N-cyclohexyl-N-methyl amino)-6-methyl-7-phenyl amino fluoran 15 parts: 1,2-bis-(3-methyl phenoxy)-ethane 15 parts: 5% aqueous solution of methyl cellulose 80 parts: water.

This composition was ground by means of a sand mill so that the mean particle size was 3 μm.

(2) Preparing composition "B"

30 parts: 4,4'-isopropylidene diphenol 30 parts: 5% aqueous solution of methyl cellolose 70 parts: water.

This composition was ground by means of a sand mill so that the mean particle size was 3 μm.

A coating composition for a thermosensitive layer was prepared by mixing and agitating 120 parts composition "A", 130 parts composition "B", 30 parts amorphous silica, 150 parts 20% aqueous solution of oxidized starch and 55 parts water.

This coating composition was applied to said undercoated base paper by means of an air knife coater so that the coating weight after drying was 5 g/m$^2$. Then, the paper was dried and calendered by means of a super calender. Thus, a thermosensitive paper was obtained.

EXAMPLE 2

A thermosensitive paper was obtained in the same way as in Example 1 except that the amount of the styrene-butadiene copolymer latex in the coating composition for the undercoated base paper was 12 parts, the wet value of the paper web was −0.26 g by weight, and the surface temperature of the paper web was changed to 45° C. by omitting blowing cold air against the paper web.

EXAMPLE 3

A thermosensitive paper was obtained in the same way as in Example 1 except that a coating composition having a solid matter concentration of 36% and a viscosity of 400 cps was used for preparing an undercoated base paper, said coating composition being prepared by mixing and agitating 70 parts (solid matter) calcined clay, 30 parts amorphous silica, 12 parts (solid matter) styrene-butadiene copolymer latex, 2 parts (solid matter) polyvinyl alcohol, and water.

EXAMPLE 4

A thermosensitive paper was obtained in the same way as in Example 1 except that the coating composition for the undercoated base paper had a solid matter concentration of 45% and a viscosity of 800 cps, and a blade coater was used in place of the Champflex coater.

EXAMPLE 5

A thermosensitive paper was obtained in the same way as in Example 1 except that the coating composition for the undercoated base paper contained 2 parts (solid matter) oxidized starch and had a viscosity of 120 cps, the paper web had a wet value of −0.20 g by weight, and the paper web immediately before coating had a surface temperature of 35° C.

COMPARATIVE EXAMPLE 1

A thermosensitive paper was obtained in the same way as in Example 1 except that the paper web was not cooled in preparing the undercoated base paper. The paper web immediately before coating had a surface temperature of 60° C.

COMPARATIVE EXAMPLE 2

A thermosensitive paper was obtained in the same way as in Example 1 except that a paper web having a wet value of +0.30 g by weight was used in preparing an undercoated base paper.

COMPARATIVE EXAMPLE 3

A thermosensitive paper was obtained in the same way as in Example 5 except that in "Preparing an undercoated base paper for a thermosensitive paper" a coating composition having a solid matter concentration of 30% and a viscosity of 15 cps was prepared by mixing and agitating 100 parts calcined clay ("Ansilex" made by EMC, USA), 12 parts (solid matter) styrene-butadiene copolymer latex ("Dow-1571" made by Asahi-Dow Co., Ltd., Japan), and water, and this coating composition was applied by means of a bar coater so that the coating weight was 4 g/m$^2$ per surface. Since the viscosity of the coating composition was low, the coating composition could not be applied well and partially caused blurs and scratches.

The evenness of coating on the undercoated base papers prepared in Examples 1 to 5 and Comparative Examples 1 to 3 and the evaluation of the thermosensitive papers prepared in said Examples and Comparative Examples are shown in Table 1.

The undercoated base papers were printed by means of an RI printing tester and the evenness of coating was visually measured. The thermosensitive papers were printed by means of a thermosensitive printer, the color density thereof being measured by means of a Macbeth densitometer ("RI-100" made by Macbeth Corporation, USA), the quality of images showing the evenness of color formation being visually measured. The results of the visual measurements are represented in Table 1 by the following four relative valuations:

◎ : Very good

○ : Good

Δ: Poor

×: Very poor.

TABLE 1

| | | Surface temp. of web (°C.) | Wet value (g) | Viscosity (cps) | Evenness of coating on undercoated base paper | Thermosensitive paper: Quality of images | Thermosensitive paper: Color density |
|---|---|---|---|---|---|---|---|
| Example | 1 | 40 | −0.10 | 300 | ○ | ○ | 1.33 |
| | 2 | 45 | −0.26 | 300 | ○ | ○ | 1.34 |
| | 3 | 40 | −0.10 | 400 | ○ | ◎ | 1.38 |
| | 4 | 40 | −0.10 | 800 | ◎ | ◎ | 1.34 |
| | 5 | 35 | −0.20 | 120 | ○ | ○ | 1.34 |
| Comp. Example | 1 | 55 | −0.10 | 300 | X | X | 1.25 |
| | 2 | 40 | +0.30 | 300 | X | X | 1.21 |
| | 3 | 35 | −0.20 | 15 | Δ | Δ | 1.25 |

EXAMPLE 6

A pigment slurry having a solid matter concentration of 70% was prepared by dispersing 80 parts kaolin ("UW-90" made by EMC, USA), 20 parts fine grain calcium carbonate ("Carbital 90" made by Fuji Kaolin Co., Ltd., Japan) and 0.2 part sodium polyacrylate in water by means of a Cowles Dissolver. A coating composition having a solid matter concentration of 60% and a viscosity of 700 cps was obtained by adding, to said pigment slurry, 2 parts (solid matter) oxidized starch, 9 parts (solid matter) styrene-butadiene copolymer latex ("JSR 0696" made by Japan Synthetic Rubber Co., Ltd., Japan), and water.

A paper web (70 g/m$^2$) having a wet value of −0.05 g by weight was dried on a cylinder dryer. Then, a cylinder thereof immediately before the coater was adapted to be used as a cooling dryer by limiting steam supply thereto by means of a steam valve thereof, so that the surface temperature of the paper web immediately before coating was 42° C. The paper web was coated on both surfaces with said coating composition by means of a blade coater so that the coating weight after drying was 20 g/m$^2$ per surface, and the paper was dried. Thus, a coated paper for printing was obtained.

EXAMPLE 7

A coated paper for printing was obtained in the same way as in Example 6 except that cold water was supplied to said cylinder immediately before the coater so that the surface temperature of the paper web immediately before coating was 35° C.

EXAMPLE 8

A coating composition having a solid matter concentration of 60% and a viscosity of 1,200 cps was prepared by mixing 50 parts kaolin ("HT" made by EMC, USA), 50 parts ground calcium carbonate ("Softon 1800" made by Bihoku Funka Co., Ltd., Japan), 6 parts (solid matter) oxidized starch, 6 parts (solid matter) styrene-butadiene copolymer latex ("JSR 0696" made by Japan Synthetic Rubber Co., Ltd., Japan), and water.

A paper web (70 g/m$^2$) having a wet value of +0.10 g by weight was adapted to have a surface tempereture of 45° C. when it had passed the drying part of the paper machine. The paper web was coated on both surfaces with said coating composition by means of a roll coater so that the coating weight after drying was 10 g/m$^2$ per surface, and the paper was dried. Thus, a coated paper for printing was obtained.

COMPARATIVE EXAMPLE 4

A coated paper for printing was obtained in the same way as in Example 6 except that the paper web was not cooled. The paper web immediately before coating had a surface temperature of 60° C.

COMPARATIVE EXAMPLE 5

A coated paper was obtained in the same way as in Example 6 except that a paper web having a wet value of −0.35 g by weight was used.

COMPARATIVE EXAMPLE 6

A coated paper for printing was obtained in the same way as in Example 7 except that a paper web having a wet value of +0.30 g by weight was used.

COMPARATIVE EXAMPLE 7

A coated paper for printing was obtained in the same way as in Example 8 except that a coating composition having a viscosity of 3,500 cps was used, said coating composition being prepared by mixing 50 parts kaolin, 50 parts ground calcium carbonate, 12 parts (solid matter) oxidized starch, 3 parts (solid matter) styrene-butadiene copolymer latex, and water. However, it was impossible to adjust the coating weight, and the coated surface was very uneven.

The printing strength, printing smoothness and mottling of the coated papers for printing prepared in Examples 6 to 8 and Comparative Examples 4 to 7 were evaluated, the results of which are shown in Table 2. The coated papers were printed by means of an R1 printer, and the printing strength, printing smoothness and mottling thereof were visually measured. The results of the visual measurements are represented in Table 2 by the following four relative valuations:

◎ : Very good
○ : Good
Δ: Poor
×: Very poor

TABLE 2

| | | Surface temp. of web (°C.) | Wet value (g) | Viscosity (cps) | Coated paper for printing: Printing strength | Coated paper for printing: Printing smoothness | Coated paper for printing: Mottling |
|---|---|---|---|---|---|---|---|
| Example | 6 | 42 | −0.05 | 700 | ○ | ◎ | ○ |
| | 7 | 35 | −0.05 | 700 | ○ | ◎ | ◎ |
| | 8 | 45 | +0.10 | 1500 | ○ | ○ | ○ |
| Comp. Example | 4 | 60 | −0.05 | 700 | ○ | Δ | X |
| | 5 | 42 | −0.35 | 700 | X | Δ | Δ |
| | 6 | 35 | +0.30 | 700 | Δ | X | X |

TABLE 2-continued

| | Surface temp. of web (°C.) | Wet value (g) | Viscosity (cps) | Coated paper for printing | | |
|---|---|---|---|---|---|---|
| | | | | Printing strength | Printing smoothness | Mottling |
| 7 | 45 | +0.10 | 3500 | — | — | — |

EXAMPLE 9

Preparing a pressure-sensitive duplicating paper

Forming a coated layer of color developer (bottom sheet)

65 parts aluminum hydroxide, 20 parts zinc oxide, 15 parts mixture (mixing ratio 80/20) of 3.5-di (γ-methyl benzil) zinc salicylate and γ-methyl styrene/styrene copolymer. 5 parts (solid matter) aqueous solution of polyvinyl alcohol, and water were mixed together and ground for 24 hours by means of a ball mill. To this dispersed system, 20 parts (solid matter) carboxy modified styrene/butadiene copolymer latex was added. Thus, a coating composition of color developer having a solid matter concentration of 40% and a viscosity of 100 cps was obtained.

A paper web (40 g/m$^2$) having a wet value of −0.20 g by weight, which had passed the drying part of the paper machine and was positioned immediately before the coater, was adapted to have a surface temperature of 30° C. The paper web was coated on one surface with said coating composition of color developer by means of a bar coater so that the coating weight after drying was 5 g/m$^2$, and the paper was dried. Thus, a bottom sheet for pressure-sensitive duplication having an even coated surface was obtained.

Forming a coated layer of capsuled dye-stuff (top sheet)

37.5 parts 20% aqueous solution of a copolymer consisting of 15 mol % vinyl sulfonic acid, 5 mol % styrene, 70 mol % acrylic acid and 10 mol % ethyl acrylate was mixed with 112.5 parts water, and the pH value thereof was adjusted to 4.6 by means of 20% aqueous solution of caustic soda. Thus was obtained an aqueous medium for making capsules. Thereto 105 parts diisopropyl naphthalene ("K-113" made by Kureha Chemical Industry Co., Ltd., Japan), in which 5 parts crystal violet lactone was dissolved, was added. This was emulsified and dispersed so that the mean particle size was 5 μm. Then, the temperature of the emulsion was increased to 70° C.

To this system, 20 parts methylated methylolmelamine precondensate ("Beckamine APM". concentration 80%, made by Dainippon Ink & Chemicals, Inc., Japan) was added. This system was maintained at a temperature of 70° C. for one hour while being agitated. Then the system was cooled and a milk-white capsule dispersion was obtained. A coating composition of capsulated dye-stuff was prepared by adding 70 parts wheat starch and 20 parts (solid matter) solubulized oxidized starch to the capsule dispersion.

A top sheet for pressure-sensitive duplication was obtained by applying said coating composition of capsulated dye-stuff to a base paper of 40 g/m$^2$ by means of an air knife coater so that the coating weight after drying was 4 g/m$^2$.

Said top sheet and bottom sheet were placed one over the other so that the surface coated with the coating composition of capsuled dye-stuff and the surface coated with the coating composition of color developer contact each other, and these sheets in this state were passed through a super calender. They showed even color images.

What is claimed is:

1. A method of making a coated paper by coating on a paper machine a paper web having a wet value of −0.30 to +0.20 g by weight, in which the paper web is continuously moving on the paper machine and has passed a drying part thereof, with a coating composition having a viscosity of 20 to 3,000 cps, the improvement comprising controlling the surface temperature of the paper web immediately before coating at or below a temperature determined by the following equation (1):

$$T = -10m + \left(\frac{1}{10}v\right)^{\frac{1}{2}} + X \quad (1)$$

where

T: surface temperature of the paper web (°C.)

m: wet value of the paper web (g by weight)

v: viscosity of the coating composition (cps)

X: X=40 or 35.

2. A method of making a coated paper as claimed in claim 1, wherein X=35.

3. A method of making a coated paper as claimed in claim 1, wherein the viscosity of the coating composition is 50 to 1,000 cps.

4. A method of making a coated paper as claimed in claim 1, wherein the wet value of the paper web immediately before coating is −0.25 to +0.10 g by weight.

* * * * *